United States Patent [19]

Hagerty

[11] 4,217,475

[45] Aug. 12, 1980

[54] APPARATUS FOR TRANSFERRING HEAT TO FLUIDS

[75] Inventor: John P. Hagerty, Prescott, Ariz.

[73] Assignee: Hagerty Research & Development Co., Inc., Prescott, Ariz.

[21] Appl. No.: 936,708

[22] Filed: Aug. 25, 1978

[51] Int. Cl.[2] ..... H05B 5/08; F01D 25/08

[52] U.S. Cl. ..... 219/10.51; 219/10.79; 219/10.49 R; 60/650; 60/682

[58] Field of Search ..... 219/10.49, 10.51, 10.79, 219/10.65; 60/203, 200 R, 650, 682

[56] References Cited

U.S. PATENT DOCUMENTS

| | | | |
|---|---|---|---|
| 2,407,562 | 9/1946 | Lofgren | 219/10.51 |
| 2,484,864 | 10/1949 | Strickland, Jr. et al. | 219/10.51 |
| 2,644,881 | 7/1953 | Schörg | 219/10.51 |
| 3,236,052 | 2/1966 | Guin | 60/650 X |
| 3,445,616 | 5/1969 | Guyer | 219/10.51 |
| 3,641,302 | 2/1972 | Sargeant | 219/10.65 |
| 3,821,508 | 6/1974 | Hagerty | 219/10.49 |
| 4,036,020 | 7/1977 | Bagley | 60/650 X |

*Primary Examiner*—B. A. Reynolds
*Assistant Examiner*—Philip H. Leung
*Attorney, Agent, or Firm*—Allen D. Gutchess, Jr.

[57] ABSTRACT

Apparatus is provided for transferring heat to fluids by the use of magnets. A first plurality of magnets is mounted in a housing in a pattern having a circular cross section. A second plurality of magnets is mounted in spaced relationship with respect to the first plurality and means are provided for moving one of the plurality of magnets relative to the other. Two concentric conductive members or sleeves of generally cylindrical shape are located in the magnetic field between the two pluralities. The two sleeves form an annular passage extending longitudinally of the magnets through which fluid to be heated is passed. The magnetic field causes the conductive sleeves to be heated by induction and transfer the heat to the fluid in an efficient manner. The inner sleeve preferably has projections extending toward the outer sleeve with longitudinally-extending passages therethrough. The outer sleeve can also have outwardly-extending projections or ridges located between rows of the magnets in the second plurality. Cooling air can be supplied outside both sleeves past the magnets of the two pluralities. This cooling air, now preheated, can be supplied to the inlet of a fluid compressor, the outlet of which communicates with the annular passage between the sleeves to supply the fluid therethrough.

12 Claims, 8 Drawing Figures

APPARATUS FOR TRANSFERRING HEAT TO FLUIDS

This invention relates to apparatus for transferring heat from conductive members located in a magnetic field to fluid passing therethrough.

The subject matter is disclosed in U.S. Pat. and Trademark Office Disclosure Document No. 070,540.

The closest known prior art are my U.S. Pat. Nos. 3,821,508, issued June 28, 1974, and 3,899,885, issued Aug. 19, 1975. Those patents disclose a first plurality or group of magnets disposed in a circular pattern, as viewed in transverse cross section, and a second plurality or group of magnets maintained in spaced relationship with respect to the first plurality. A conductive member is positioned in the space between the two groups of magnets and one of the groups of magnets is rotated to establish variable flux therebetween by the alternate retraction and repulsion, or variation in the strength of the retraction or repulsion, of the magnets. This induces heating of the conductive member and a fluid, such as air, is then moved past the heated member, in heat-transfer relationship. The fluid then becomes heated and ready to impart energy as it exits as a heated working fluid.

In accordance with the present invention, a first conductive member or sleeve is located around the first plurality of magnets and is of generally cylindrical shape. A second conductive member or sleeve is located outside the first sleeve in coaxial relationship and is of generally cylindrical shape, with the two sleeves forming an annular passage extending longitudinally between the first and second plurality of magnets. Fluid is then passed through the annular passage formed by the sleeves with heat being transferred thereto from both of the sleeves which are heated by the variable flux established by the rotation of one of the plurality of magnets, preferably the first. The first sleeve can have a plurality of projections extending toward the second sleeve, preferably with openings or longitudinal passages in the projections through which some of the fluid can pass. The second sleeve can also have outwardly extending projections or ridges extending outwardly between some of the rows of magnets of the second plurality for improved heat transfer relationship.

The first and second pluralities of magnets can be located in a housing having passages through which cooling fluid can be directed past the first plurality of magnets and also past the second plurality of magnets, more specifically between the inner surface of the first sleeve and the first plurality of magnets, and between the outer surface of the second sleeve and the second plurality of magnets. This cooling fluid, now heated, can be supplied to the inlet of a compressor, the outlet of which supplies compressed fluid through the annular passage formed by the sleeves. A common engine can be employed to drive the compressor and also to rotate the rotatable plurality of magnets in the housing.

It is, therefore, a principal object of the invention to provide improved apparatus for heating a fluid by means of a magnetic field.

Another object of the invention is to provide two spaced pluralities of magnets with two conductive members forming a passage therebetween through which fluid can flow for heat transfer relationship from the conductive members which are heated by the magnetic field established between the magnets and by movement of one of the pluralities.

A further object of the invention is to provide conductive members between two pluralities of magnets, one of which is rotated relative to the other, with a compressor for supplying fluid through the passage and with the compressor intake receiving cooling fluid flowing past the two pluralities of magnets outside of the passage.

Many other objects and advantages of the invention will be apparent from the following detailed description of preferred embodiments thereof, reference being made to the accompanying drawings, in which.

Figure 1:
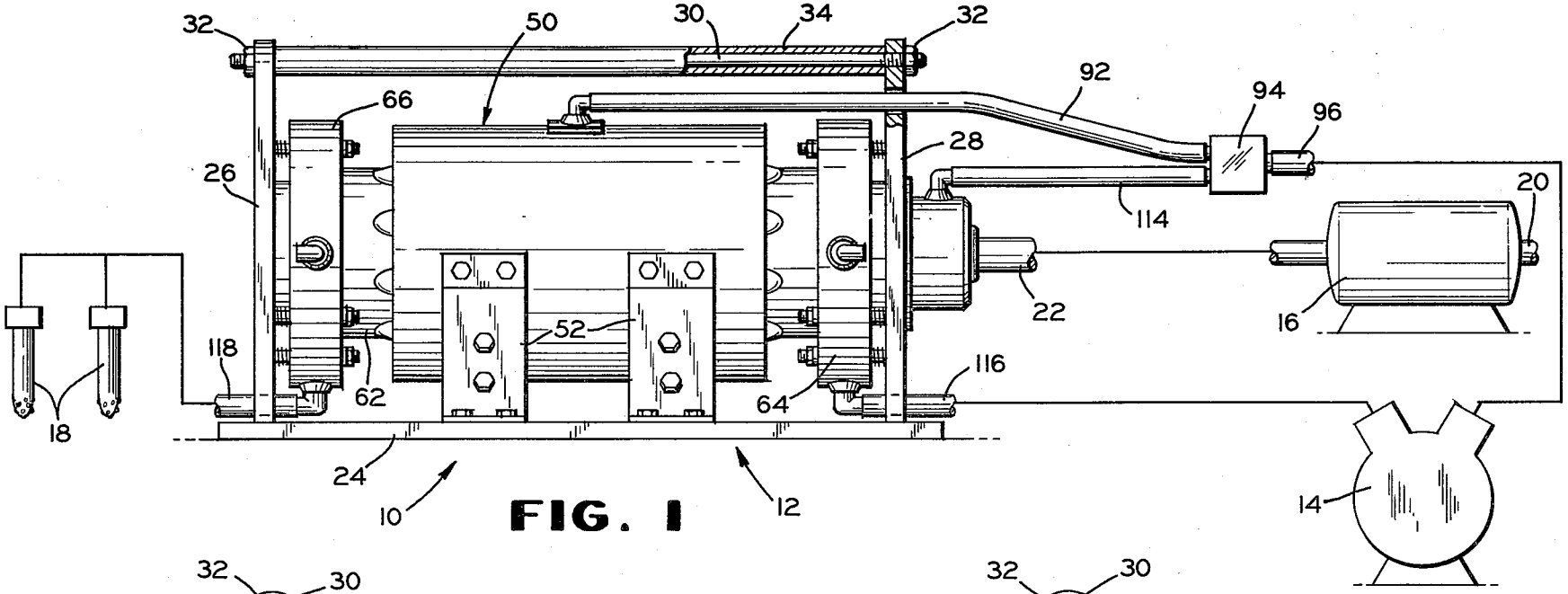
FIG. 1 is a somewhat schematic, side view in elevation, with parts broken away and with parts in section, of apparatus embodying the invention.
Figure 2:
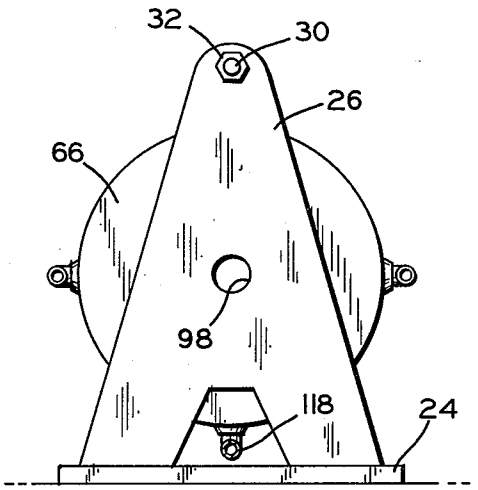
FIG. 2 is a left end view of the apparatus of FIG. 1.
Figure 3:
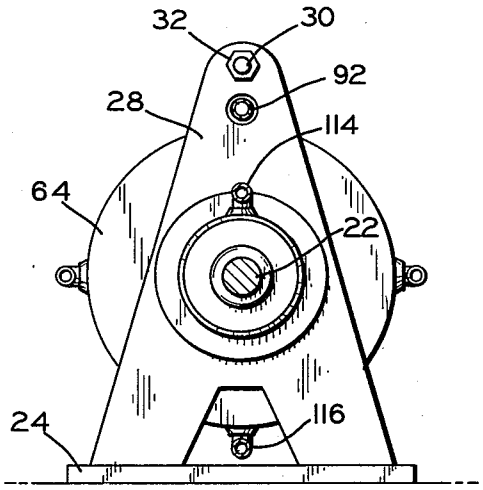
FIG. 3 is a right end view of the apparatus, taken along the line 3—3 of FIG. 1.

Referring particularly to FIGS. 1-3, overall apparatus embodying the invention is indicated at 10. The apparatus includes a heating unit indicated at 12, a compressor 14, and an engine 16 for driving the compressor and the heating unit. Heated, compressed fluid from the heating unit 12 is used to operate various devices, pneumatic rock drills schematically shown at 18, in this instance. The engine 16 can be fueled with gasoline or diesel oil and drives the compressor 14 through a shaft 20 and rotates a shaft 22 of the heating unit 12, which will be discussed subsequently. The overall heating unit 12 is mounted on a base 24 with upstanding end frames 26 and 28. These are connected by a tie rod 30 having end nuts 32 and a spacer tube 34 between the end frames.

Figure 4:
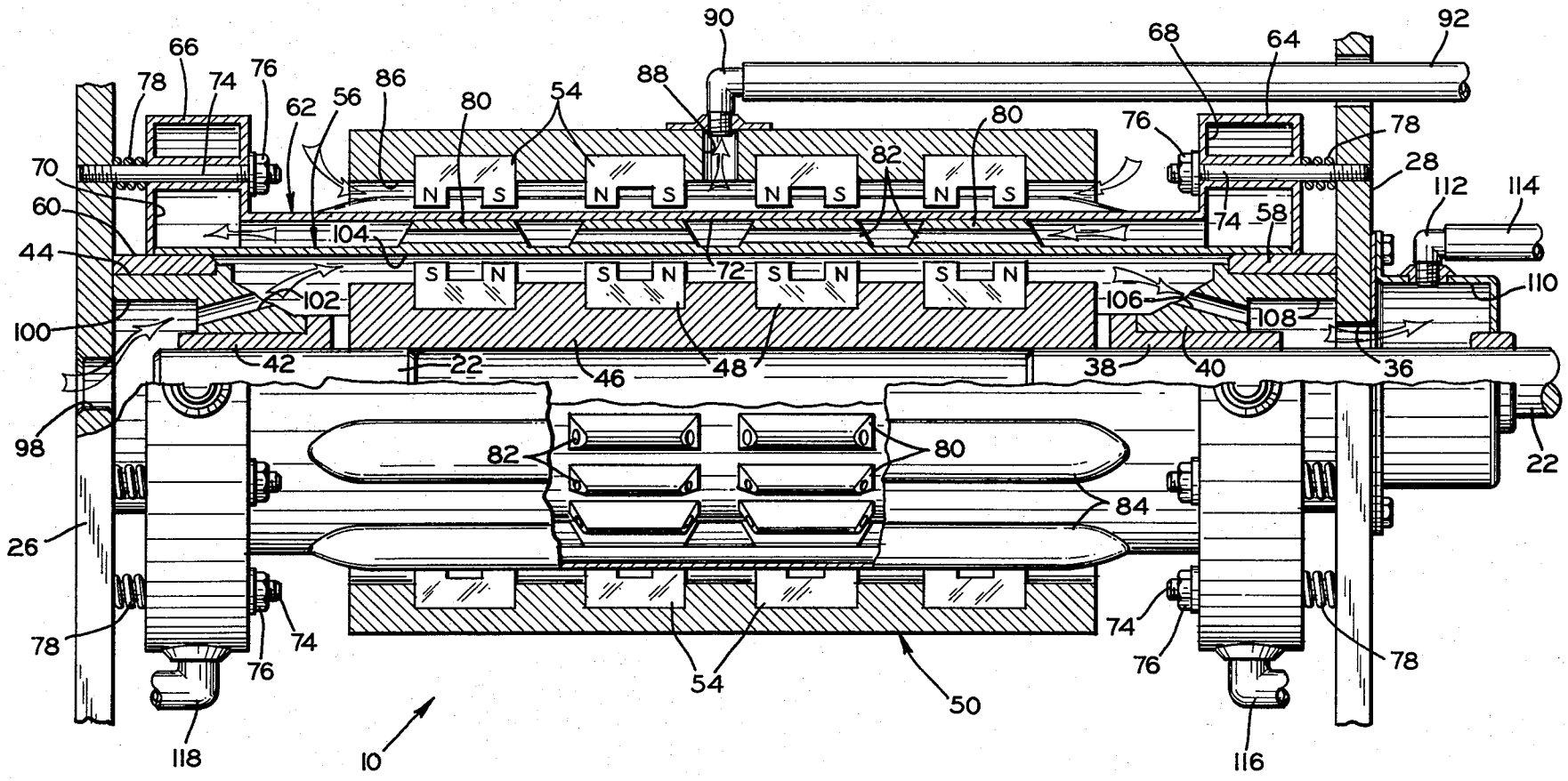
FIG. 4 is a somewhat schematic, enlarged view, with parts broken away and with parts in section, of the heating unit of the apparatus of FIG. 1.
Figure 5:
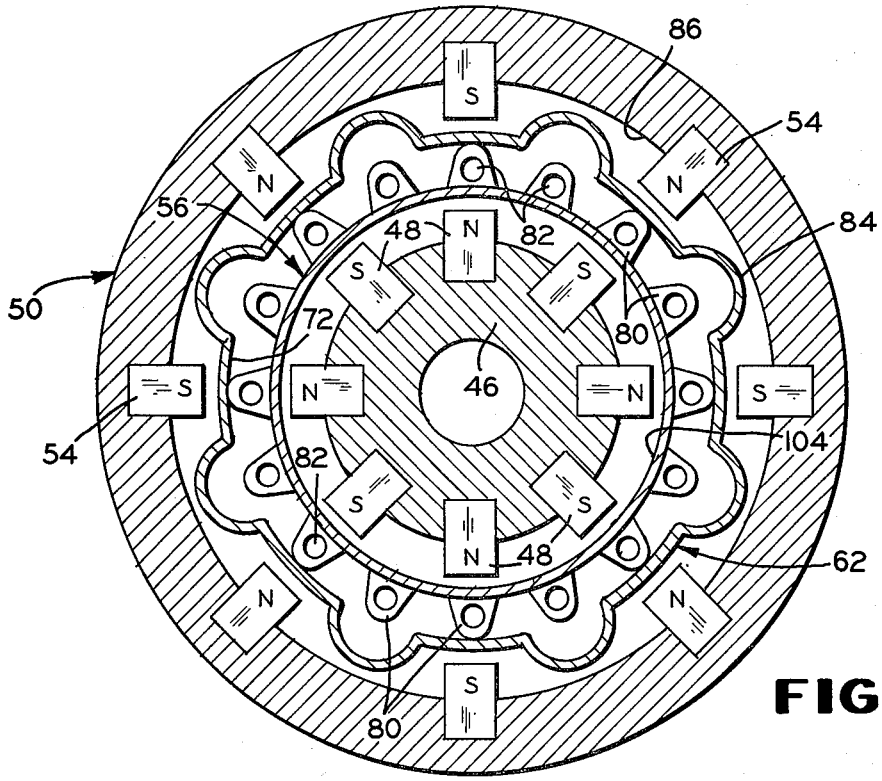
FIG. 5 is a view in transverse cross section, on a further enlarged scale, of the heating unit of FIG. 4.

Referring to FIG. 4, the end frame 28 has an opening 36 through which the drive shaft 22 extends. The shaft is rotatably supported in a bearing 38 which is held in a bearing mount 40. The mount 40, in turn, is suitably affixed to the end frame, as by welding or suitable flanges (not shown). The shaft 22, or an extension thereof, also is received in a bearing 42 held in a bearing mount 44 affixed to the other end frame 26.

A rotor 46 is mounted on the shaft 22 and has a first plurality of magnets 48 mounted therein with the legs or ends extending radially outwardly and forming a circular pattern in transverse cross section. The magnets can be of the permanent type, as shown, or electromagnets can be employed. The first plurality of the magnets 48 are rotated with the rotor 46 when the shaft 22 is driven by the engine 16.

An outer housing 50 is positioned around the first plurality of magnets and the rotor 46, being suitably supported by the legs 52 (FIG. 1) on the base 24. The housing 50 carries a second plurality of magnets 54 which are also located in a circular pattern, concentrically positioned with respect to the first plurality of magnets.

In accordance with the invention, a first conductive, generally cylindrical member or sleeve 56 is positioned in the annular space between the two pluralities of magnets and is located closer to the first plurality. The sleeve 56 is supported on carbon sleeves 58 and 60 located on the bearing mounts 40 and 44. A second conductive, generally cylindrical member or sleeve 62 is located in the annular space between the two pluralities of magnets and outside the first sleeve 56, being concentrically positioned with respect thereto. The sleeves are both heated by induction and both rapidly transfer heat to fluid. The increased heat transfer can enable the final temperature of the outlet fluid to be higher or the overall heating unit can be shorter. The unit can also be reduced in diameter.

The sleeves 56 and 62 are suitably affixed to end manifolds 64 and 66 which form annular chambers 68 and 70. These communicate with an annular, longitudinally-extending passage 72 formed by the concentric sleeves 56 and 62. The manifolds 64 and 66 are supported by the end frames 26 and 28 through bolts 74 and nuts 76, with springs 78 located on the bolts 74 between the manifolds and the end frames. This construction enables the sleeves 56 and 62 to extend longitudinally toward and away from the end frames for contraction and expansion purposes. The sleeves and the manifolds at the ends can be made of heat resistant metal not affected by oxidation at elevated temperatures; such materials include Inconel, nichrome, and certain stainless steel alloys.

Heat transferred to fluid flowing through the passage 72 from the sleeves 56 and 62 is enhanced by a plurality of projections or heat dispensers 80 located on the outer surface of the sleeve 56 and extending outwardly toward the sleeve 62. The projections 80 have longitudinally-extending passages 82 therein through which a portion of the fluid directed through the passage 72 can flow. The projections 80 extend substantially to the inner surface of the sleeve 62 but can move relative thereto for radial expansion and contraction.

The outer sleeve 62, in this instance, also has outwardly extending, longitudinal projections or ridges 84 positioned between rows of the magnets 54 of the second plurality to provide a greater surface area and more heat transfer to the fluid. Of course, the projections 80 on the sleeve 56 and the ridges 84 on the sleeve 62 are not essential to the invention but do increase the rate of heat transfer to the fluid when they are employed.

Cooling air is provided for the second plurality of magnets. Accordingly, an annular cooling passage 86 is formed between the outer surface of the outer sleeve 62 and the inner surface of the housing 50. The ends of the housing 50 are open and a central portion of the housing has a transverse outlet opening 88. An elbow fitting 90 communicates with that opening and a flexible outlet hose 92 is connected to the fitting. Referring to FIG. 1, the hose 92 communicates with a manifold 94 from which an intake conduit or line 96 extends to the inlet of the compressor 14.

Cooling air or fluid is also provided for the first plurality of the magnets 48. For this purpose, the end frame 26 has an inlet opening 98 communicating with a hollow chamber 100 in the bearing mount 44. The mount 44 has a plurality of slanted passages 102 which communicate with a passage 104 formed between the inner surface of the first sleeve 56 and the outer surface of the rotor 46. The passage 104 communicates with slanted passages 106 and a chamber 108 in the bearing mount 40. The chamber 108 connects through the opening 36 with an outer collector or manifold 110. A fitting 112 in the manifold 110 is connected to a flexible outlet hose 114 which communicates with the manifold 94.

When the compressor 14 is operated, it draws fluid through the intake line 96. Cooling fluid is thereby drawn through the passage 86 from the outer ends of the housing 50 and through the hose 92. This air cools the region of the magnets 54 of the second plurality. Cooling fluid is similarly drawn through the central opening 98 in the end frame 26 where it flows through the passage 104 past the magnets 48 of the first plurality and to the manifold 110 and the hose 114. Thus, the preheated cooling fluid enters the compressor 14 at an elevated temperature. From here it is compressed and heated somewhat further and supplied to an intake line 116. The compressed fluid then flows through the manifold 64 and through the passage 72 between the sleeves 56 and 62. The fluid, now at a high elevated temperature in pressure, is supplied from the end manifold chamber 70 through an outlet line 118 to the rock drills 18. There can be a plurality of fittings and lines around the manifolds 64 and 66, of course.

Figure 6:
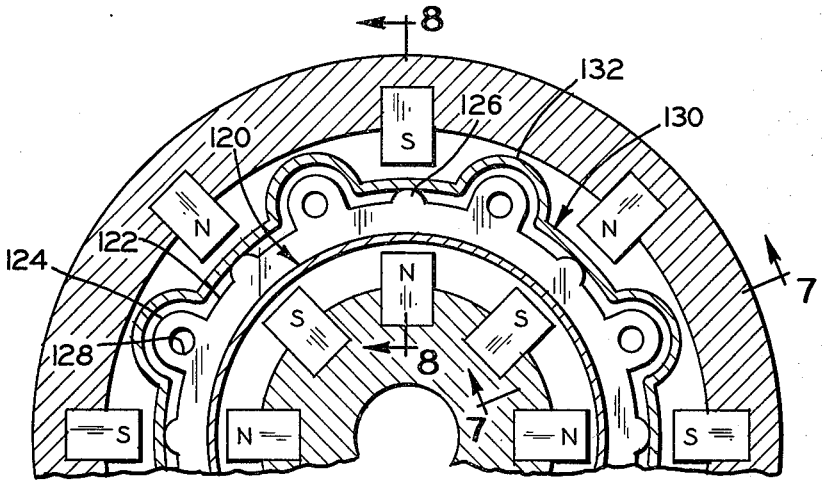
FIG. 6 is a fragmentary view, otherwise similar to FIG. 5, of a modification of the invention.
Figure 8:
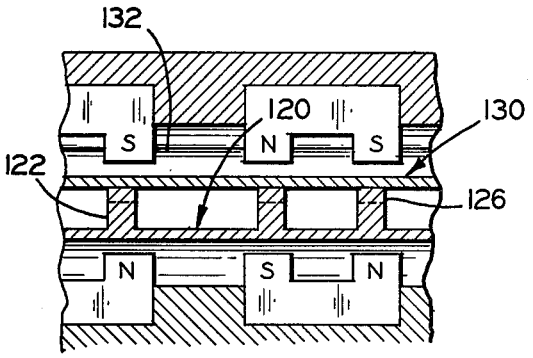
FIG. 8 is a fragmentary view in cross section, taken along the line 8—8 of FIG. 6.
Figure 7:
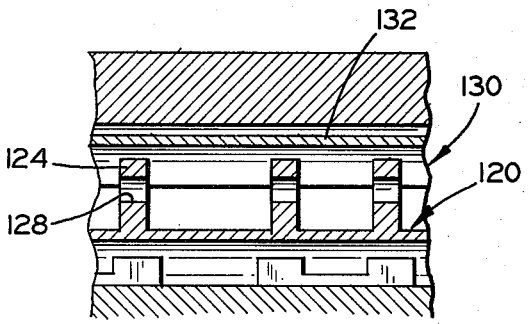
FIG. 7 is a fragmentary view in cross section, taken along the line 7—7 of FIG. 6.

Slightly modified heat exchange means are shown in FIGS. 6–8. In this instance, an inner sleeve 120 has a plurality of annularly extending ridges 122 with larger projections or ears 124 and smaller projections or ears 126. The ears 124 have openings 128 through which a portion of the fluid being heated can pass. An outer sleeve 130 has a plurality of longitudinally-extending ridges 132 thereon extending between rows of the outer plurality of magnets with the ears 124 extending into the interior of the ridges 132.

Various modifications of the above-described preferred embodiments of the invention will be apparent to those skilled in the art, and it is to be understood that such modifications can be made without departing from the scope of the invention, if they are within the spirit and the tenor of the accompanying claims.

I claim:

1. In apparatus for heating a fluid comprising a first plurality of magnets, means holding said first plurality of magnets in a predetermined pattern, a second plurality of magnets, means holding the second plurality of magnets in a predetermined pattern in spaced relationship with respect to said first plurality of magnets, and means for moving at least one of said plurality magnets relative to the other, the improvement comprising a stationary conductive member of generally cylindrical shape, a second stationary conductive member of generally cylindrical shape, means positioning said conductive members in the space between said first and said second plurality of magnets with said second conductive member located outside said first conductive member, means for passing a first stream of cooling fluid between said first conductive member and said first plurality of magnets, means for passing a second stream of cooling fluid between said second conductive member and said second plurality of magnets, and means for passing fluid from both streams in heat transfer relationship between said first and said second conductive members.

2. Apparatus according to claim 1 characterized by said first and second streams moving in common directions and the fluid passing between said first and said second conductive members moving in the opposite direction.

3. Apparatus according to claim 1 characterized by a compressor having an inlet communicating with said first and said second streams and having an outlet for supplying the fluid between said first and said second conductive members.

4. Apparatus according to claim 3 characterized by a device which is operated by heated, compressed fluid, and passage means connecting the space between said first and said second conductive members with said device.

5. Apparatus according to claim 1 characterized by said second conductive member having a plurality of ridges extending outwardly between magnets of said second plurality.

6. Apparatus according to claim 1 characterized by said first conductive member having projections extending outwardly toward said second conductive member.

7. Apparatus according to claim 5 characterized by said first conductive member having projections extending outwardly toward said second conductive member.

8. Apparatus according to claim 5 characterized by said first member having projections extending into the interior of said ridges of said second member.

9. Apparatus according to claim 6 characterized by said projections having longitudinally-extending passages therethrough through which fluid can pass.

10. Apparatus according to claim 6 characterized by said projections having openings through which fluid can pass.

11. Apparatus for heating fluid comprising a first plurality of magnets, a second plurality of magnets, means holding the second plurality of magnets in a predetermined pattern and in spaced relationship with respect to said first plurality, means for moving at least one of said plurality of magnets relative to the other, stationary heat exchange means positioned in the space between said first and said second plurality of magnets, a compressor for supplying fluid under pressure in a first stream in one direction between said first and said second plurality of magnets and in heat exchange relationship with said heat exchange means, means for supplying cooling fluid in a second stream in the opposite direction past said first plurality of magnets, means for supplying cooling fluid in a third stream in the same direction as said second stream past said second plurality of magnets, and means for supplying the cooling fluid to the intake of said compressor.

12. Apparatus according to claim 11 wherein said heat exchange means comprises two generally cylindrical members positioned between said first and said second plurality of magnets and in coaxial relationship, said fluid under pressure being directed between said first and said second generally cylindrical members, and the cooling fluid being directed between said members and said first plurality of magnets and between said members and said second plurality of magnets.

* * * * *